United States Patent [19]

Reed et al.

[11] 4,089,639

[45] May 18, 1978

[54] FUEL-WATER VAPOR PREMIX FOR LOW NOX BURNING

[75] Inventors: Robert D. Reed, Tulsa; Eugene C. McGill, Skiatook, both of Okla.

[73] Assignee: John Zink Company, Tulsa, Okla.

[21] Appl. No.: 527,196

[22] Filed: Nov. 26, 1974

[51] Int. Cl.[2] ..... F23D 11/44

[52] U.S. Cl. ..... 431/211; 431/4; 431/5; 431/11; 431/202

[58] Field of Search ..... 431/2, 4, 210, 211, 431/212, 11, 5, 202

[56] References Cited

U.S. PATENT DOCUMENTS

| | | | |
|---|---|---|---|
| 885,972 | 4/1908 | Bennett | 431/4 |
| 3,804,579 | 4/1974 | Wilhelm | 431/211 |
| 3,814,567 | 6/1974 | Zink et al. | 431/4 |
| 3,829,275 | 8/1974 | Stranahan et al. | 431/4 |
| 3,921,389 | 11/1975 | Kawaguchi | 60/39.05 |

*Primary Examiner*—Edward G. Favors

*Attorney, Agent, or Firm*—Head, Johnson & Chafin

[57] ABSTRACT

A method and apparatus for burning fuels with air, with reduced production of NOx, involves the premixing of water vapor with the fuel prior to the burning operation. Because of the low retention of water vapor at low temperatures, means are provided for preheating the fuel and spraying water into the fuel so that water vapor will be taken up by the heated fuel in sufficient quantity to provide the desired results. Various embodiments of apparatus are illustrated.

12 Claims, 7 Drawing Figures

FUEL-WATER VAPOR PREMIX FOR LOW NOX BURNING

BACKGROUND OF THE INVENTION

In the art of burning fuels in air for any purpose, and regardless of the manner in which the fuel is burned, there is oxidation of the nitrogen, which is a part of the air used as a source of oxygen for combustion of the fuel.

Oxidation of nitrogen, which is an endothermal reaction results in the presence of NOx, as either or both of, NO and $NO_2$. Oxides of nitrogen, through atmospheric reaction, produce "smog", and because of this the NOx content of gases discharged to the atmosphere is severely limited by various state and federal agencies.

Widely reported researches have shown that if water, or water vapor, is added to the air for combustion, or if water is added to the combustion zone in any convenient manner (such as water injection to internal combustion engines in aircraft) certain beneficial effects are noted, such as accelerated burning of fuel, lowering of ignition temperature, greater power generation and reduction of NOx emission as has been discovered in later work. However, the reduction in Nox emission is far from adequate for compliance with existing regulations. In the prior art it has been well known to inject steam into the flame zone where combustion is in progress to improve the overall operation of fuel burning. However, the premixture of water with fuel prior to combustion reaction has neither been examined nor reported in prior research as far as is known in point of reduced NOx emission.

This invention lies in the field of combustion of fuels. More particularly, it concerns combustion of fuels in a way to reduce the NOx emissions to the atmosphere. Still more particularly it concerns methods of adding water or water vapor to fuel in sufficient quantity, prior to entering the combustion zone, so as to facilitate combustion and to reduce the NOx emissions down to the level required by regulatory agencies. While the method can be applied to all fluid fuels, it has greatest advantage with gaseous fuels.

SUMMARY OF THE INVENTION it is a primary object of this invention to provide a method and apparatus for reducing the concentration of NOx in the emissions from a combustion zone. It is a further object of this invention to provide method and apparatus for reducing the NOx emissions to a suitably low level in a manner that is relatively simple and inexpensive.

Because of the demand for NOx reduction to a level which is adequate for compliance with regulations, further work has been down, and one result has shown that if steam or water vapor is added to a fuel gas prior to the combustion reaction, and in such manner as to provide a suitable fuel-water vapor mixture prior to combustion, the NOx emission is reduced adequately.

There is considerable argument as to why the reduction in NOx emission occurs. One school of thought asserts that reduced NOx emission, i.e., from several hundreds of parts per million to a level of 30 to 50 parts per million, is due to the cooling of the flame by steam or water vapor, as mixed with the gaseous fuel rather than with the air for combustion. A second school of thought believes that reduction in NOx emission is due to altered burning chemistry.

Alteration in burning chemistry occurs within the flame body where, due to fuel mixture with water vapor prior to combustion, and as fuel-water mixture temperature rises toward ignition temperature, the fuel can either react with oxygen, or it can react with the water vapor, as in the following equation:

$$CH_4 + H_2O = CO + 3H_2$$

In any combustion apparatus there are zones within the flame which have excess oxygen and others which are deficient in oxygen. Therefore, and because of the great chemical reactivity of CO and $H_2$, these gases react with either NO or $NO_2$ to form either $CO_2$ or $H_2O$ within the oxygen-deficient flame zones to result in greatly reduced $NO_x$ emission, as previously noted. Also, as has been noted, there is no certainty that cooling alone or altered burning chemistry alone accomplished the result of reduced NOx emission, or whether both effects contribute. However, it is proven that the permixture of gas fuel with water or water vapor, prior to combustion, greatly reduces Nox emission in gas fuel burning. In one case which is not to be considered limiting, 21 mol percent of water vapor pre-mixed with gaseous fuel, produced the greatest reduction in NOx emission but liquid water also produces NOx reduction.

Whether a specific mol percentage of water vapor is, or is not, required for minimum NOx emission, it may be considered that some significant mole percentage is required. However, significant mol percentages of water vapor in such cases demand temperatures capable of avoiding dew point for the water vapor which is present or available from liquid water. As examples, the following saturation temperatures for water vapor in gas are well known:

1.75% vapor: 60F
3.5% vapor: 80F
6.75% vapor: 100F
11.50% vapor: 120F
19.90% vapor: 140F
25.75% vapor: 150F Since fuel gas temperatures are normally 100F or less, and from the above tabulation, it will be seen that for mole percentages of water vapor in gas fuel in excess of 6.75%, the temperature of the gas-water vapor mixture, must be elevated, for minimal NOx emission in gas fuel burning, and prior to the burning of the fuel. This has been verified by spraying water of weight equal to 21 mol percent into fuel gas prior to burning to produce markedly less reducton in NOx emission (approximately 80%), when gas temperature as water was sprayed in, was approximately 60F.

Because of the cooling effect of water, as a liquid, it has a flame cooling effect 2.36 times greater than an equivalent amount of steam in the flame zone. The importance of flame cooling is to all appearances reduced, and the importance of water in the vapor phase is emphasized, but there is still no proof of the effect of chemistry of burning alteration being entirely responsible for reduced NOx emission. However, there is evidence that water vapor as premixed with the gas fuel has great effect where the water vapor is as steam, which elevates the temperature of the steam-fuel gas mixture, to enable delivery of a maximum of water in vapor phase to the flame zone prior to combustion.

Both water as a liquid, and water in vapor phase, may be considered desirable for effects in the flame zone for wide range control of NOx emission. There is no certainty that either flame cooling or chemistry alone is responsible for reduced NOx emission, or what degree of NOx reduction may be attributed to either one, in all cases where fuel is burned. However, if water is sprayed into the gas fuel prior to combustion, it is necessary, in order to maximize water vapor resulting from such spraying, that the gas, prior to entry of water spray, be preheated in any convenient manner to assure high enough temperature level after gas-water mixture, to keep the water in vapor phase. Also, it may be preferred to supply heat after the gas-water mixture, for the same reason, and according to the weight ratio of water to gas as mixed.

Water for spraying into gas is preferable to the injection of steam for water vapor enrichment of fuel gas, because in any case, the cost per pound of water is a fraction of the cost per pound of steam. This results in less operating costs along with minimal NOx emission. This is particularly true when it is considered that gas preheat can be accomplished by waste heat recovery, to result in greater recovery of heat produced through the burning of fuels and thus provide higher thermal efficiency.

Apparatus for this invention involves five embodiments. The first invloves the use of steam injected into the gas line prior to the combustion zone. This provides a high degree of water vapor retention in the fuel because of the heating effect of the steam. A second method involves the spraying of water into the gas fuel line prior to the combustion zone. A third embodiment involves the same apparatus as in the second method, with the added step of preheating the gas prior to the entry of the water spray into the gas. A fourth embodiment involves passing the preheated fuel gas through a water bath to pick up water vapor. A fifth embodiment involves preheating the gas, injecting water and additionally mixing with additional preheated fuel gas, in order to raise the temperature of the gas and entrained water vapor prior to combustion.

These and other objects and advantages of this invention and a better understanding of the principles and details of the invention will be evident from the following description taken in conjunction with the appended drawings in which.

DESCRIPTION OF THE PREFERRED EMBODIMENT

Figure 1A:
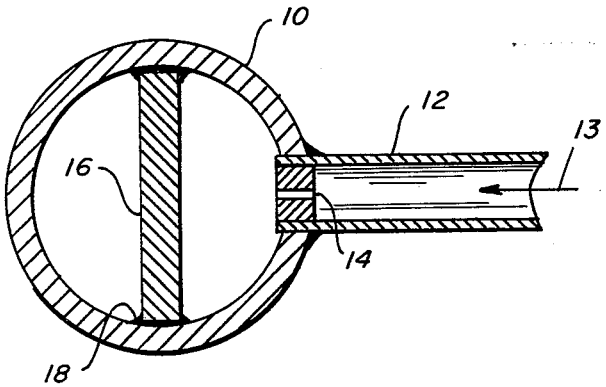
FIGS. 1A and 1B represent one embodiment of the water spray apparatus.
Figure 1B:
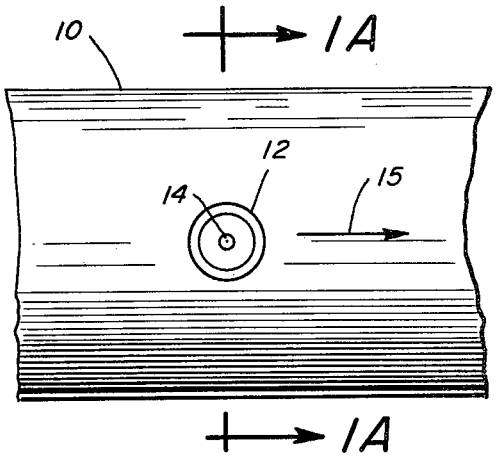

Referring now to the drawings and in particular to FIGS. 1A and 1B, there are shown two view of one embodiment of apparatus for injection water into fuel gas prior to entry into the combustion zone. Shown in FIG. 1A is a cross section through the apparatus in the plane 1A—1A of FIG. 1B. This comprises a fuel gas pipe 10 with a smaller diameter pipe 12 entering at right angle. Water is introduced into the pipe 12 under pressure and flows through an orifice 14 and impinges on a baffle plate 16 which is positioned in the pipe 10 opposite the pipe 12. The baffle 16 can be attached by any desired means such as welds 18, for example. The purpose of the baffle is to create a fine spray as high pressure stream of water impinges on the baffle thus making it more convenient for the gas to pick up the water vapor. FIG. 1B shows another view of the apparatus of FIG. 1A.

Figure 2A:
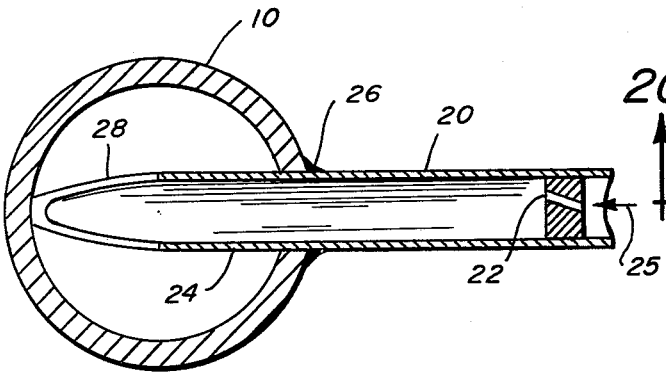
FIGS. 2A, 2B and 2C represent a second embodiment of the water spray apparatus.
Figure 2B:
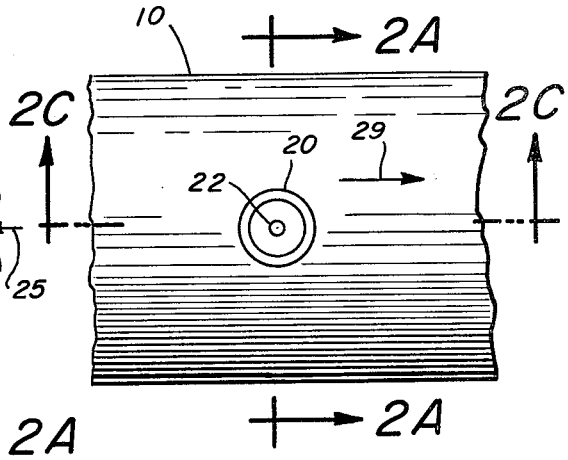
Figure 2C:
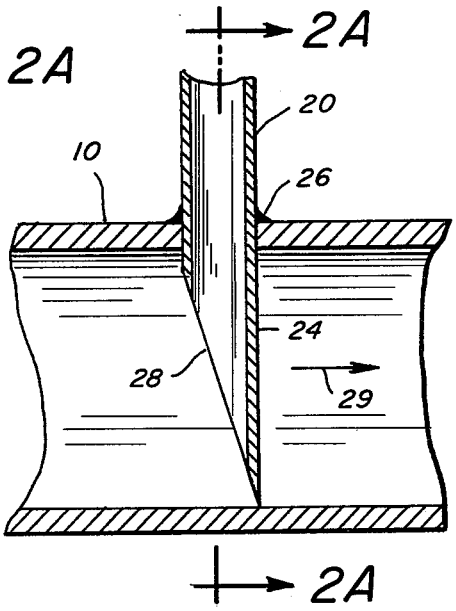

Referring now to FIGS. 2A, 2B and 2C, there are three views shown of a second embodiment. FIG. 2A is in cross section along the plane 2A—2A of FIG. 2B. FIG. 2C is in cross section along the plane 2C—2C of FIG. 2B. Here again, a side pipe 20 is attached as by welding through the wall of the gas fuel pipe 10. A small orifice 22 is placed in the pipe 20 and positioned at an angle, so that as the water stream under pressure passes through the orifice 22 it will swirl and impinge on the wall of the tube 20 and in this way will be broken up into a fine spray of droplets. The portion 24 of the pipe 20 inside of the gas line 10 is cut off at an angle leaving a face 28 as shown in FIG. 2C. The open face of the pipe is upstream to the gas flow as indicated by arrow 29.

Figure 3:
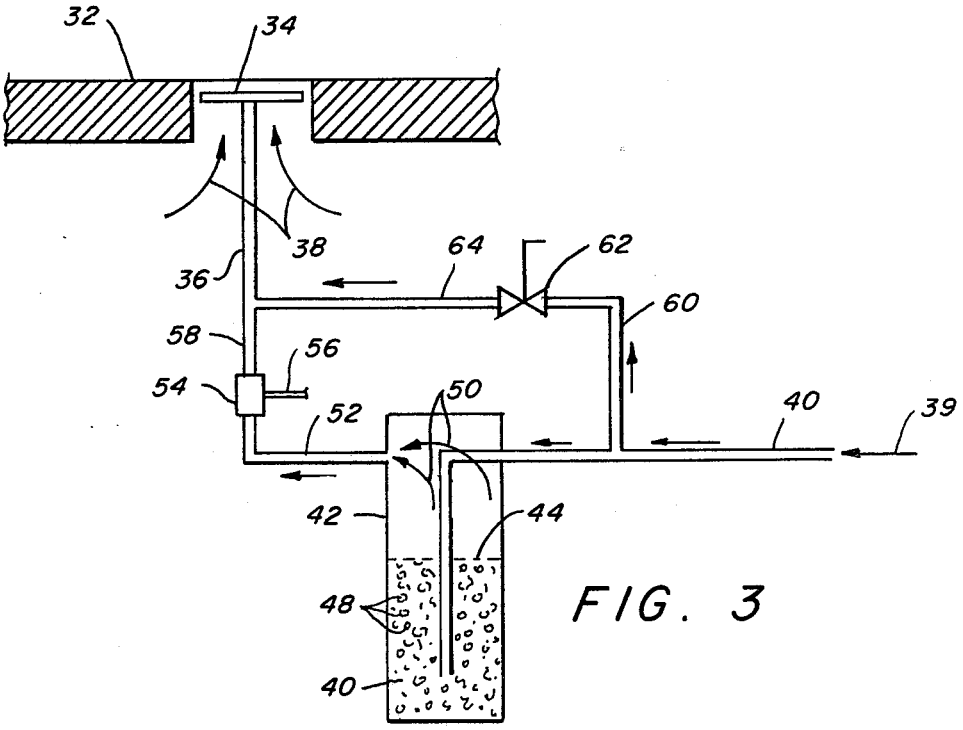
FIG. 3 illustrates a combination of heated fuel gas passing through a water bath with additional water injection.

Referring now to FIG. 3, there is shown in the upper portion of the figure a part of the wall 32 of a furnace or combustion device, with an opening in which is inserted a burner 34, with means for combustion air to flow in under the burner in accordance with arrows 38. The fuel gas-water vapor mixture flows to the burner 34 through line 36. Preheated gas enters the pipe 40 in accordance with arrow 39, and flows into a water bath 40 in a chamber 42 having water level 44. The heated gas bubbles up through the water 40 in the form of bubbles 48 and flows in accordance with arrows 50 through an outlet pipe 52. The heated gas picks up water vapor in this process to a saturation value depending on the temperature of the gas as it leaves the water apparatus 42.

Provision is made for a water spray or injection apparatus 54 similar to one of those described in FIGS. 1A, B and FIGS. 2A, B, C. Water enters the spray device 54 through pipe 56. Outlet pipe 58 carries the pre-heated gas with water vapor with other injected water into pipe 36 and to the burner. A by-pass is provided from the pre-heated fuel gas line 40, through line 60, control valve 62 and line 64, into the fuel pipe 36 to the burner. The purpose of this bypass is to carry preheated fuel in controlled volume at the temperature of the inlet 40, so that by mixture of it with the cooled but water vapor plus water laden fuel that comes through pipe 58, additional heat can be supplied after cooling of the fuel due to contact with liquid water, to assure ample water vapor-fuel premixture.

Figure 4:
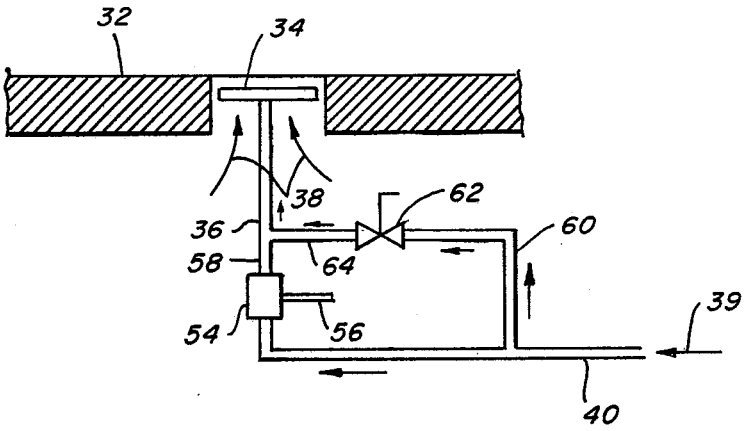
FIG. 4 illustrates a system utilizing preheated fuel gas, water spray and additional mixing with preheated fuel gas.

FIG. 4 illustrates a portion of the apparatus of FIG. 3. Here the water bath apparatus 42 has been eliminated and the preheated fuel gas flows from pipe 40 to the water spray apparatus 54 having an inlet water line 56. The water and water vapor laden fuel gas flows through line 58 to the fuel supply line 36 to the burner 34. Here again, and more particularly, the bypass line 60 and 64 with valve 62 provide an opportunity to supply preheated fuel gas as required to the mixture of water, water vapor and fuel gas in line 58 to heat that mixture prior to passage to the burner 34, so as to provide a maximum amount of water vapor.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed is:

1. In a fuel burning system in which gaseous fuel carried within a conduit is mixed with air in a combustion zone, the improvement comprising, (a) means for adding water as vapor or liquid droplets to said fuel conduit prior to reaching said combustion zone in which said means for adding water droplets comprises;

(b) gas conduit means;

(c) second conduit means entering said gas conduit transversely;

(d) orifice means in said second conduit means, said orifice means co-axial with said second conduit;

(e) means to supply water under pressure to said second conduit means; and (f) impingement means within the path of said water issuing from said orifice means.

2. The system as in claim 1, wherein said impingement means includes baffle means in said gas conduit opposite said second conduit, whereby said pressurized stream of water through said orifice will strike said baffle and form a plurality of small droplets of water.

3. The system as in claim 1 in which said side conduit projects into the interior of said gas conduit, and wherein said projecting part of said side conduit is beveled off on the upstream side.

4. The system as in claim 3 in which said orifice is drilled through the orifice plug at an angle to the longitudinal axis of said side pipe.

5. In a gaseous fuel-burning system in which said fuel is mixed with air in a combustion zone, the improvement comprising:

(a) means to inject droplets of water into a conduit carrying said gaseous fuel;

(b) means to preheat said gaseous fuel before entry into said means to inject said droplets of water; and (c) means to add preheated gaseous fuel to said water vapor-gaseous fuel mixture exiting from said means to inject droplets of water.

6. In a fuel gas burning system in which said fuel is mixed with air in a combustion zone, the improvement comprising:

(a) means to bubble said fuel gas through a column of water to add water vapor to said fuel gas;

(b) means to preheat said fuel gas before entry into said means to bubble; and (c) means to add preheated fuel gas to said water vapor-fuel mixture exiting from said means to bubble.

7. In a fuel gas burning system in which said fuel is mixed with air in a combustion zone, the improvement comprising:

(a) means to inject droplets of water into a conduit carrying said fuel gas to thus add water vapor to said fuel gas;

(b) means to preheat said fuel gas before entry into said means to inject said droplets of water; and (c) means to heat said fuel gas after the injection of water droplets.

8. In a gaseous fuel burning system in which said fuel carried within a conduit is mixed with air in a combustion zone, the improvement comprising:

(a) means to inject droplets of water into said fuel conduit prior to reaching said combustion zone; and (b) means to preheat said fuel gas before entry into said means to inject said droplets of water.

9. In a gaseous fuel burning system in which said fuel carried within a conduit is mixed with air in a combustion zone, the improvement comprising:

(a) means to bubble said gaseous fuel through a column of water for adding water vapor to said fuel conduit prior to reaching said combustion zone; and (b) means to preheat said fuel gas before entry into said means to bubble.

10. In a fuel burning system in which fuel carried within a conduit is mixed with air in a combustion zone, the improvement comprising:

(a) means for adding water vapor to said fuel conduit prior to reaching said combustion zone; and (b) means to preheat said fuel gas prior to adding water vapor.

11. The system as in claim 10 wherein said means to preheat preheats said fuel gas to at least 100° F.

12. The system as in claim 10 wherein said means to preheat preheats said fuel gas to at least 140° F.

* * * * *